US005389452A

United States Patent [19]

Nakajima et al.

[11] Patent Number: 5,389,452

[45] Date of Patent: Feb. 14, 1995

[54] ALUMINUM PLATE EXCELLENT IN FORMABILITY

[75] Inventors: Hiroki Nakajima; Kimikazu Ikemoto, both of Toyota; Yoshirou Tomioka, Anjo; Yutaka Suzuki, Toyota; Shinichiro Nakamura, Nagoya; Masaru Adachi, Osaka; Yuzo Kawakami, Kainan; Kuniaki Matsui; Tsuneharu Mori, both of Moka, all of Japan

[73] Assignees: Toyota Jidosha Kabushiki Kaisha, Toyota; Kabushiki Kaisha Kobe Seiko Sho, Kobe, both of Japan

[21] Appl. No.: 57,472

[22] Filed: May 6, 1993

[30] Foreign Application Priority Data

May 8, 1992 [JP] Japan ..... 4-115850

[51] Int. Cl.[6] ..... B32B 15/04

[52] U.S. Cl. ..... 428/624; 428/650; 428/652; 428/653

[58] Field of Search ..... 428/650, 653, 624, 652; 72/42; 252/32.5, 56 R, 56 S; 29/DIG. 2

[56] References Cited

U.S. PATENT DOCUMENTS

| | | | |
|---|---|---|---|
| 4,092,448 | 5/1978 | Coll-Palagos | 427/383 D |
| 4,101,386 | 7/1978 | Dotzer et al. | 204/32 R |
| 4,113,635 | 9/1978 | Sakurai et al. | 252/49.6 |
| 4,191,658 | 3/1980 | Jahnke | 252/32.7 |
| 4,321,308 | 3/1982 | Jahnke | 428/469 |
| 4,612,128 | 9/1986 | Uematsu et al. | 252/32.5 |
| 4,659,488 | 4/1987 | Vinci | 252/33 |
| 4,672,007 | 6/1987 | Teng et al. | 428/624 |
| 4,803,000 | 2/1989 | Uematsu et al. | 252/32.5 |
| 5,116,521 | 5/1992 | Fujii et al. | 251/18 |

FOREIGN PATENT DOCUMENTS

| | | |
|---|---|---|
| 0177021 | 4/1986 | European Pat. Off. . |
| 2545500 | 4/1976 | Germany . |
| 260524 | 9/1988 | Germany . |
| 2134538 | 8/1984 | United Kingdom . |

OTHER PUBLICATIONS

Derwent Publications, Ltd., AN-81-01104D C02, JP-A-55 144 096, Nov. 11, 1980.

Kirk-Othmer *Encyclopedia of Chemical Technology,* 3rd ed. 1980, vol. 9, pp. 802 805.

Hawley Gessner The Condensed Chemical Dictionary, 1981 p. 909.

*Primary Examiner*—John Zimmerman

*Attorney, Agent, or Firm*—Oblon, Spivak, McClelland, Maier & Neustadt

[57] ABSTRACT

The object of the present invention is to provide an aluminum plate for fabrication which has an excellent formability, easy degrease after fabrication, coating properties, and less tendency of flawing, in which the aluminum plate for fabrication which is plated, and coated with a lubricant containing (A) a fatty acid ester of polyol, (B) an alkaline or alkaline metal salt of sulfonate, and (C) a controlling agent, and having saponification value of 20 or more.

12 Claims, No Drawings

ALUMINUM PLATE EXCELLENT IN FORMABILITY

BACKGROUND OF THE INVENTION

The present invention relates to an aluminum plate, especially an aluminum plate suitable for a press forming for parts of a car. The aluminum plate of the present invention is not only excellent in the formability at the press forming but also excellent in the prevention of flawing at handling or forming. Further, it is coated with good appearance because of its excellent degreasing.

Recently, the consumption of an aluminum plate for car parts becomes gradually increased for the sake of lightening of a car. The aluminum plate, however, has a less formability than a steel plate, so it has various problems such as lower yield and limited design due to its tendency of cracking at processing. Further, the aluminum plate is easily scratched at handling or forming or stamping because of its soft surface.

In order to solve such problems it has been proposed that the aluminum plate is plated with a hard metal on the surface to prevent it from flawing and to improve the formability by reducing the friction coefficient with a die. It has been also tried that a lubricant is coated on the plated metal so as to improve the lubricity.

SUMMARY OF THE INVENTION

There are two problems in the above proposals, one of which is insufficient lubricity, because the surface of the hard metal plating is easily dried when a conventional lubricant is used in a small amount, and the surface is rough, hard and brittle; and the other problem is the degreasing property after fabrication becomes worse, if a high viscous lubricant or a solid lubricant such as a wax type lubricant is used in order to improve such a lubricity.

The objects of the present invention are to solve the above problems, and to provide an aluminum plate for fabrication excellent in formability, prevention of flawing, degreasing after fabrication and coating properties. The aluminum plate is plated with another metal, and coated with a oily film of a lubricant comprising (A) a fatty acid ester of polyol, (B) an alkaline or alkaline earth metal salt of sulfonic acid, and (C) a controlling agent, and having a saponification value of 20 or more on the surface of the plate.

THE DETAILED DESCRIPTION OF THE INVENTION

The present invention provides an aluminum plate which is plated with another metal, and coated with a oily film of a lubricant comprising (A) a fatty acid ester of polyol, (B) an alkaline or alkaline earth metal salt of sulfonic acid, and (C) a controlling agent, and having a saponification value of 20 or more on the surface of the plate.

The polyol ester (A) functions as a lubricant. The fatty acid of the ester includes a saturated or unsaturated fatty acid having a carbon number of from 6 to 22, preferably 10 to 18, which may have a branch, for example, stearic acid, isostearic acid, lauric acid, neodecanoic acid, oleic acid, erucic acid and the like.

The polyol of the ester may be a polyol having 2 to 12 hydroxyl groups, preferably 2 to 4, more preferably 2 or 3 hydroxyl groups, for example, trimethylolpropane, neopentyl glycol, pentaerythritol and the like. Mixture of two or more kinds of the polyol may be used.

The aluminum plate excellent in corrosion resistance, press forming property, degreasing property, and adhesive property can be obtained by applying a controlled amount of lubricant of the present invention on the plated aluminum plate due to its excellent adsorbability, heat resistance, viscosity properties, volatility resistance and good balance of various additives such as a corrosion inhibitor and a specific oiling agent The sulfonate of the ingredient (B) functions as a corrosion inhibitor and a lubricant. As the sulfonate there are exemplified a petroleum sulfonate, synthetic sulfonate, for example, alkylbenzene sulfonate, alkylnaphthalene sulfonate and the like. Preferable salts include alkaline metal salts such as lithium, sodium, potassium salts and the like, and alkaline earth metal salts such as magnesium, calcium, barium salts and the like. The term "salt" used in the present specification means a neutral, basic or super basic salt. A mixture of two or more kinds of sulfonate may be used.

The controlling agent (C) is used as a diluent, which is effective to mainly control the viscosity, saponification value of the lubricant and the like. As the controlling agent (C) there are exemplified mineral oil such as a machine oil (e.g. 9 cst/40 ° C.), a machine oil (e.g. 46 cst/40 ° C.) and the like, a synthetic hydrocarbon (2–20cst/100 ° C.), an $\alpha$-olefin, a synthetic naphthene (MW 130–250), an ester such as lauryl oleate, dioctyl sebacate and the like.

The amount of the ingredient (A) to be formulated is 7 to 60 % by weight, preferably 13 to 40 % by weight based on the total weight of the lubricant of the present invention; the amount of the ingredient (B) is 1 to 40 % by weight, preferably 11 to 25 % by weight based on the total weight of the lubricant; and the amount of the ingredient (C) is 15 to 82 % by weight, preferably 30 to 60 % by weight.

The other important feature of the lubricant of the present invention is that the saponification value of the lubricant having the above ingredient is 20 or more, preferably 20 to 100, more preferably 40 to 70.

When the saponification value is less than 20, the lubricant cannot be applied evenly on the surface of a plated aluminum plate so as to cause a trouble such as break and the like at the press forming of the aluminum plate.

According to the present invention an extreme pressure additive may be used in addition to the above ingredients. As the extreme pressure additive an organic metal compound, an organic boron compound, an organic phosphorous compound and the like may be exemplified, which exhibits lubricity under high pressure.

Concrete examples of the organic metal compound include an organic molybdenum compound such as Sanflick FM-2 (available from Sanyo Kasei Kogyo K.K.), zinc dithiophosphate (ZDTP) and the like.

Concrete examples of the organic boron compound include an alkylamine borate and the like.

Concrete examples of the phosphorous compound include tricresyl phosphate, amine 2-ethylhexyl acid phosphate, trioleyl phosphate and the like.

As thiophosphate trilauryl trithiophosphate and the like are exemplified.

Two or more kinds of extreme pressure additives may be used in the same extreme pressure additive based on the lubricant. The amount of the lubricant is 10 % by weight or less, preferably 0.2 to 3 % by weight.

The lubricant according to the present invention may contain general additives which is usually added to a conventional lubricant such as a surfactant, an antioxidant, a stain preventing agent, a corrosion inhibitor for nonferrous metals and the like.

The amount of the lubricant applied on the surface of the aluminum plate is preferably 0.5 to 5.0 g/m$^2$, more preferably 1 to 2 g/m$^2$. When the coated amount is less than 0.5 g/m$^2$, the press lubricity becomes so insufficient that the plate is liable to break. Even if the lubricant is applied in the amount of 5g/m$^2$ or more, a corrosion inhibiting oil flows out of the plate after coiling or cutting to sheets and packing, and the degreasing property and the adhesive properties becomes worse.

The term "aluminum plate" in the present specification also includes aluminum alloy such as Al-Mg alloy, Al-Mg-Si alloy, Al-Cu alloy and the like in its concept.

According to the present invention any metal harder than aluminum may be plated on the surface of the aluminum plate for fabrication at the thickness of 1 g/m$^2$ or more, by which the surface of the plate is hardened and the surface is protected from flawing at handling or press forming.

As materials harder than aluminum plate iron, iron-zinc, zinc-nickel and the like are exemplified.

When the thickness of the plating layer of the harder metal is less than 1 g/m$^2$, the effect of the plating is not so sufficient and the surface of the plate is not prevented from flawing. If, however, the thickness exceeds 50 g/m$^2$, the effects are not improved

EXAMPLE

Formulation of Lubricant:

Five kinds of lubricant of the present invention were prepared according to Table 1.

In Table 1 the mixed fatty acid A represents a mixed fatty acid which has an average carbon number of 16.5 and contains mainly saturated fatty acids, and the mixed fatty acid B represents a mixed fatty acid which has an average carbon number of 16.5, and contains mainly unsaturated fatty acids.

TABLE 1

| ingredients lubricant No. | 1 | 2 | 3 | 4 | 5 |
|---|---|---|---|---|---|
| ester of mixed fatty acid A and trimethylol propane | 23.4 | 20.5 | | 4.0 | 23.4 |
| ester of mixed fatty acid B and neopentyl glycol | | | | 9.0 | |
| ester of mixed fatty acid B and pentaerythritol | | | 5.5 | | |
| ester of mixed fatty acid A and neopentyl glycol | 10.0 | | 30.0 | | 10.0 |
| ester of mixed fatty acid B and trimethylol propane | | 3.0 | | | |

TABLE 1-continued

| ingredients lubricant No. | 1 | 2 | 3 | 4 | 5 |
|---|---|---|---|---|---|
| mineral oil (9 cst/40° C.) | 45.0 | | 38.1 | 56.4 | 25.2 |
| mineral oil (46 cst/40° C.) | | 55.4 | | | |
| α-olefin | | 10.0 | | | |
| synthetic naphthene | | | | 20.0 | 20.0 |
| Ca synthetic sulfonate | 13.5 | 15.0 | 10.0 | 4.0 | 13.5 |
| Ba petroleum sulfonate | | | 2.5 | 6.0 | |
| Na synthetic sulfonate | 7.5 | 5.5 | 2.5 | | 7.5 |
| organic molybdenum compound | 0.2 | | | | |
| alkyl borate | | | 0.5 | | |
| amine alkyl phosphate | | | 0.3 | 0.2 | |
| surfactant | | 0.2 | | | |
| stain preventing agent | 0.2 | | 0.2 | 0.2 | 0.2 |
| antioxidant | | 0.2 | 0.2 | | |
| corrosion inhibitor for nonferrous metals | 0.2 | 0.2 | 0.2 | 0.2 | 0.2 |
| saponification value (mg KOH/g) | 55 | 45 | 67 | 22 | 55 |
| viscosity (cts at 40° C.) | 20 | 45 | 25 | 13 | 5 |

Five kinds of conventional lubricants were prepared according to the formulation shown in Table 2 to be compared with the lubricant of the present invention.

TABLE 2

| | (comparative) | | | | |
|---|---|---|---|---|---|
| ingredients/lubricant No. | 6 | 7 | 8 | 9 | 10 |
| mineral oil | 92.0 | 91.0 | 38.0 | | 91.0 |
| Na petroleum sulfonate | 5.0 | 2.0 | 2.0 | | 3.0 |
| oxidized wax ester | 3.0 | 1.0 | 10.0 | | 6.0 |
| fat and oil | | 6.0 | 40.0 | | |
| paraffin wax | | | 10.0 | | |
| ammonium salt of acrylic acid ester acrylate | | | | 25.0 | |
| copolymer of maleic acid and butadiene | | | | 5.0 | |
| emulsifier | | | | 5.0 | |
| water | | | | 65.0 | |
| saponification value (mg KOH/G) | 6 | 13 | 105 | — | 12 |
| viscosity (cst at 40° C.) | 5 | 17 | 10 | — | 4 |

note:
Lubricant No. 6: oil type rust preventive,
Lubricant No. 7: oil and wax type rust preventive,
Lubricant No. 8: wax type rust preventive,
Lubricant No. 9: dry film type
Lubricant No. 10: washing oil An aluminum plate of Mg(5%)-containing aluminum alloy having a O-temper and a thickness of 1.0 mm was used. The aluminum plate was electrically plated with Zn (10%)-containing iron to a thickness of 0.8 to 15 g/m$^2$.

The above aluminum plates were plated under the condition indicated in Table 3, and then the lubricant Nos. 1–8 were coated thereon to give test pieces. The lubricity, forming properties, degreasing properties and flawing were evaluated. The results were shown in Table 3.

TABLE 3

| Test No. | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|
| Example/Comp. Ex. | C.1 | C.2 | Ex. 1 | Ex. 2 | Ex. 3 | Ex. 4 | Ex. 5 | C.3 | C.4 | C.5 | C.6 | C.7 | Ex. 6 | C.8 | C.9 | Ex. 7 |
| thickness of plating (g/m$^2$) | — | 10 | 10 | 10 | 10 | 10 | 10 | 10 | 10 | 10 | 10 | 10 | 10 | 10 | 0.8 | 15 |
| lubricant No. | 10 | 10 | 4 | 1 | 2 | 3 | 5 | 6 | 7 | 8 | 9 | 4 | 4 | 4 | 4 | 4 |
| sapon. value | 12 | 12 | 22 | 55 | 45 | 67 | 55 | 6 | 13 | 105 | — | 22 | 22 | 22 | 22 | 22 |
| amount (g/m$^2$) | 1 | 1 | 1 | 1 | 1 | 1 | 1 | 1 | 1 | 1 | 1 | 0.2 | 2 | 6 | 1 | 1 |
| lubricity and formability | | | | | | | | | | | | | | | | |
| friction | 0.19 | 0.15 | 0.13 | 0.11 | 0.12 | 0.11 | 0.14 | 0.18 | 0.17 | 0.10 | 0.08 | 0.17 | 0.14 | 0.14 | 0.15 | 0.13 |
| coefficient | C | B | A | A | A | A | A | B | B | A | A | B | A | A | B | A |
| height of | 14.2 | 14.6 | 15.0 | 15.3 | 15.1 | 15.4 | 14.9 | 14.1 | 14.4 | 15.3 | 16.5 | 14.3 | 15.0 | 15.0 | 14.6 | 15.1 |
| wrinkle (mm) | C | B | A | A | A | A | A | C | B | A | A | B | A | A | B | A |
| easiness of | 100 | 95 | 90 | 85 | 90 | 80 | 80 | 90 | 95 | 50 | 60 | 95 | 90 | 70 | 90 | 85 |
| degreasing (%) | A | A | A | A | A | A | A | A | A | C | B | A | A | B | A | A |
| resistance against | 75 | 125 | 125 | 125 | 125 | 125 | 125 | 125 | 125 | 125 | 125 | 125 | 125 | 125 | 80 | 140 |

TABLE 3-continued

| Test No. | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|
| Example/Comp. Ex. | C.1 | C.2 | Ex. 1 | Ex. 2 | Ex. 3 | Ex. 4 | Ex. 5 | C.3 | C.4 | C.5 | C.6 | C.7 | Ex. 6 | C.8 | C.9 | Ex. 7 |
| flawing (Hv) | C | A | A | A | A | A | A | A | A | A | A | A | A | A | B | A |

The above evaluation tests were as follows:

I. Lubricity and Formability:

i) Evaluation of lubricity based on the friction coefficient:

Method

A plain sliding friction test was carried out under the following conditions to determine the friction coefficient, which was used as an evaluation of lubricity.

blank holding pressure: 0.5 kg/mm$^2$, velocity: 500 mm/min.

evaluation:

A: less than 0.15,

B: 0.15–0.18

C: more than 0.18 ii) Evaluation of formability based on critical wrinkle height:

Method

The drawing test was carried out under the following conditions to determine the critical wrinkle height up to the cracking, which was used as an indicator of fabrication. This test was made 3 times in each plate, and the average was shown in Table 3.

Shape of test plate: 1.0$^t$×90 mm $\phi$ punch diameter: 40 mm $\phi$ (R 8 mm)

punch velocity: 120 mm/min.

Evaluation

A: 14.8 mm or more,

B: from 14.3 mm or more to less than 14.8 mm,

C: less than 14.3 mm

II Easiness of Degreasing

Method

Each lubricant was applied on the surface of aluminum plate in a given amount to prepare test panels. Degreasing test was made on the above test panels under the following conditions. The easiness of degreasing was expressed by wettability (percentage of wetted area). The test was carried out 3 times each lubricant, and the average was shown in Table 3.

washing liquid for degreasing: commercially available alkaline degreasing liquid (pH 11)

degreasing condition: at 40 ° C. for 2 minutes washing: washed with water for 2 minutes Evaluation:

A: 80 % or more

B: from 60 % or more to less than 80 %

C: less than 60 %

III. Liability of Flaw

Method

The surface hardness was expressed by Vickers hardness (25 g). The larger hardness indicates the higher resistance against flaw.

Evaluation

A: 100 or more

B: from 80 or more to less than 100

C: less than 80

What we claim is:

1. A plated aluminum plate for fabrication comprising a plating layer of another metal on the surface of an aluminum plate and an oily film of a lubricant having a saponification value of 20 to 100 mgKOH/g, said lubricant comprising:

(A) 13–40% by weight of a fatty acid ester of a polyol, (B) 11–25% by weight of an alkali metal salt of sulfonic acid or an alkaline earth metal salt of sulfonic acid, and (C) 30–60% by weight of a controlling agent for controlling the viscosity and saponification value of the lubricant.

2. The plates aluminum of claim 1, wherein the lubricant further comprises 10% by weight or less of an extreme pressure additive.

3. The plated aluminum plate of claim 1, wherein the oily film of a lubricant is present in an amount of 0.5 to 5.0 g/m$^2$.

4. The plated aluminum plate of claim 1, wherein the plating layer consists of a metal having a higher hardness than that of the aluminum and has a thickness of 1 g/m$^2$ or more.

5. The plated aluminum plate of claim 1, wherein the viscosity of the lubricant is from 5 to 45 cSt at 40° C.

6. The plated aluminum plate of claim 1, wherein the fatty acid ester of a polyol is the stearic, isostearic, lauric, neodecanoic, oleic or erucic ester of trimethylol propane, or neopentyl glycol.

7. The plated aluminum plate of claim 1, wherein said controlling agent is an $\alpha$-olefin, a synthetic naphthene having a molecular weight of 130–250, lauryl oleate or dioctyl sebacate.

8. The plated aluminum plate of claim 1, wherein said plating layer of another metal consists of iron, iron-zinc, or zinc-nickel.

9. The plated aluminum plate of claim 2, wherein said extreme pressure additive is present in an amount of 0.2 to 3% by weight based on the lubricant.

10. The plated aluminum plate of claim 2, wherein said extreme pressure additive is selected from the group consisting of zinc dithiophosphate, alkylamine borate, tricresyl phosphate, amine 2-ethylhexyl acid phosphate, trioleyl phosphate and trilauryl trithiophosphate.

11. The plated aluminum plate of claim 5, wherein said saponification value is from 22 to 67 mg KOH/g.

12. The plated aluminum plate of claim 1, wherein said component (A) is present in an amount of from 13–35.5% by weight.

* * * * *